United States Patent [19]

Morikawa et al.

[11] Patent Number: 4,558,473

[45] Date of Patent: Dec. 17, 1985

[54] SANITARY CLEANING EQUIPMENT

[75] Inventors: Yoshitaka Morikawa, Yamatokoriyama; Hiroyuki Matsui, Osaka, both of Japan

[73] Assignee: Matsushita Electric Industrial Co., Ltd., Osaka, Japan

[21] Appl. No.: 557,165

[22] PCT Filed: Mar. 16, 1983

[86] PCT No.: PCT/JP83/00080

§ 371 Date: Nov. 15, 1983

§ 102(e) Date: Nov. 15, 1983

[87] PCT Pub. No.: WO83/03272

PCT Pub. Date: Sep. 29, 1983

[30] Foreign Application Priority Data

Mar. 17, 1982 [JP] Japan ..... 57-43441
Mar. 17, 1982 [JP] Japan ..... 57-43442
Mar. 17, 1982 [JP] Japan ..... 57-43446

[51] Int. Cl.[4] ..... A47K 4/00; A47K 3/20; A61H 35/00; E03D 9/08

[52] U.S. Cl. ..... 4/420.2; 4/420.4; 4/420.5; 4/213; 4/DIG. 6; 4/443; 4/447; 4/448

[58] Field of Search ..... 4/443, 447, 420.2, 213, 4/444, 448, 420.1, 420.5, 420.4, DIG. 6; 128/66

[56] References Cited

U.S. PATENT DOCUMENTS

| | | | |
|---|---|---|---|
| 2,875,450 | 3/1959 | Umann | 4/447 |
| 3,247,524 | 4/1966 | Umann | 4/447 X |
| 3,995,326 | 12/1976 | Umann | 4/420.2 X |
| 4,087,868 | 5/1978 | Gentz | 4/447 |
| 4,237,560 | 12/1980 | Riegelman et al. | 4/447 |
| 4,317,242 | 3/1982 | Stamper | 4/213 |
| 4,411,030 | 10/1983 | Kawai et al. | 4/443 |
| 4,422,189 | 12/1983 | Couvrette | 4/443 X |
| 4,422,190 | 12/1983 | Huang | 4/443 |

*Primary Examiner*—Henry K. Artis
*Attorney, Agent, or Firm*—Spencer & Frank

[57] ABSTRACT

This invention relates to a sanitary cleaning equipment which includes a flushing portion adapted to direct a jet of cleaning water against a selected area, a deodorizing portion for withdrawing odoriferous air from the neighborhood of the selected area and deodorizing the same, and a dryer portion adapted to direct a jet of warm air against the area. The above deodorizing portion has a first wind tunnel including a deodorant and the above dryer portion has a second wind tunnel including a heater, the first and second wind tunnels being constructed so that they are selectively communicated with a single fan by switching operation of a damper device, thereby providing a sanitary cleaning equipment which is compact and has a high warm air blowing efficiency and a high deodorization efficiency.

12 Claims, 11 Drawing Figures

SANITARY CLEANING EQUIPMENT

BACKGROUND OF THE INVENTION

This invention relates to a sanitary cleaning equipment comprising a flushing device adapted to deliver a jet of cleaning water to a selected area to be cleaned, a deodorizing device for withdrawing odoriferous air from the neighborhood of said selected area, and a dryer adapted to deliver a jet of warm air to said area.

As illustrated in FIG. 10, a sanitary cleaning equipment of this type is generally used in combination with a western-style water closet. This equipment consists of a flushing device for cleaning a selected area of the user's body with a jet of cleaning water from a nozzle 4 disposed within a toilet (1), a dryer unit 9 for directing a jet of warm air against said area to thereby dry the same, and a deodorizing unit 11 for withdrawing odoriferous air from the neighborhood of said part within the toilet and deodorizing the air by passage thereof through a deodorant. More particularly, said sanitary cleaning equipment comprises a pump 6 for drawing up water from a tank 5 disposed in the water closet and supplying it under pressure to said nozzle 4, and a warm water tank 7 interposed between said pump 6 and said nozzle 4 and equipped with the heater for warming a cleaning water. Said dryer unit 9 comprises a motor 8, a fan and a heater (not shown) for generating a warm air current for drying the flushed area of the user's body. Said deodorizing unit 11 comprises a deodorant tank 10, and control sections 12 and 13. In addition, a heater 3 is embedded in a cover 2 on the bowl 1.

While this conventional equipment has many desirable functional features and is useful, it has to be undesirably large as a whole because independent motor and fan means must be provided for said dryer unit 9 and deodorizing unit 11.

One might contemplate using a single fan means for providing air currents necessary for both the drying and deodorizing functions. However, to do so, a heater for generating a warm air current and a deodorant having a relatively large flow resistance must be provided in the same air passageway and this imposes a new problem. Thus, not only the necessary heater but also the deodorant is present in the current passageway even when the warm drying air current is made available, the deodorant being unnecessary in this case, and since the deodorant acts as a large resistance to the air current, the current cannot have a sufficiently high velocity so that the warm air blowing efficiency is lowered. To compensate for this deficiency, a motor having an increased capacity has to be provided.

SUMMARY OF THE INVENTION

Under the foregoing circumstances and with attention to the problems inherent in the prior art equipment, this invention was conceived to provide air currents for both the drying and deodorizing functions through use of a single fan means to thereby reduce the size of the whole equipment and prevent a decrease of the warm air blowing efficiency. To accomplish the above-mentioned objects, this invention provides a system such that a first wind tunnel having a deodorant disposed therein and a second wind tunnel having a heater unit disposed therein are selectively communicated with a single fan unit.

A preferred embodiment of this invention will now be described, reference being had to the accompanying drawings.

DESCRIPTION OF A PREFERRED EMBODIMENT

Figure 1:
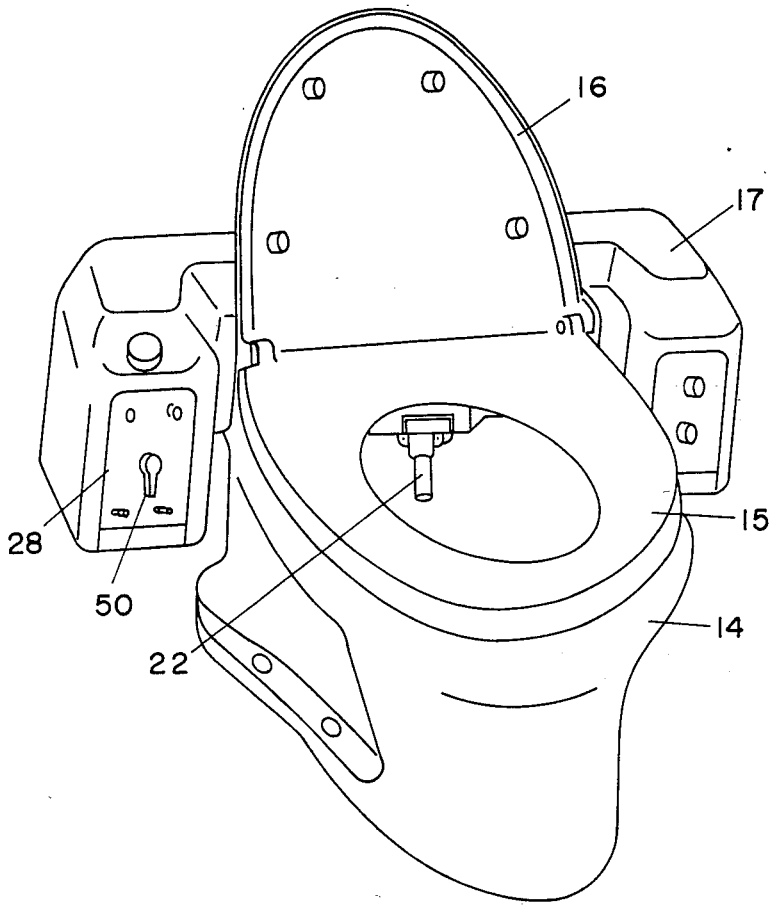
FIG. 1 is a perspective exterior view showing a sanitary cleaning equipment embodying the principles of this invention.

Referring to FIG. 1, there is shown a toilet bowl 14 fitted with a seat 15 having an air heater embedded therein (not shown), with a cover 16 being additionally disposed to open and close the bowl. Further, disposed behind said toilet bowl 14 is a sanitary cleaning equipment body 17.

Figure 2:
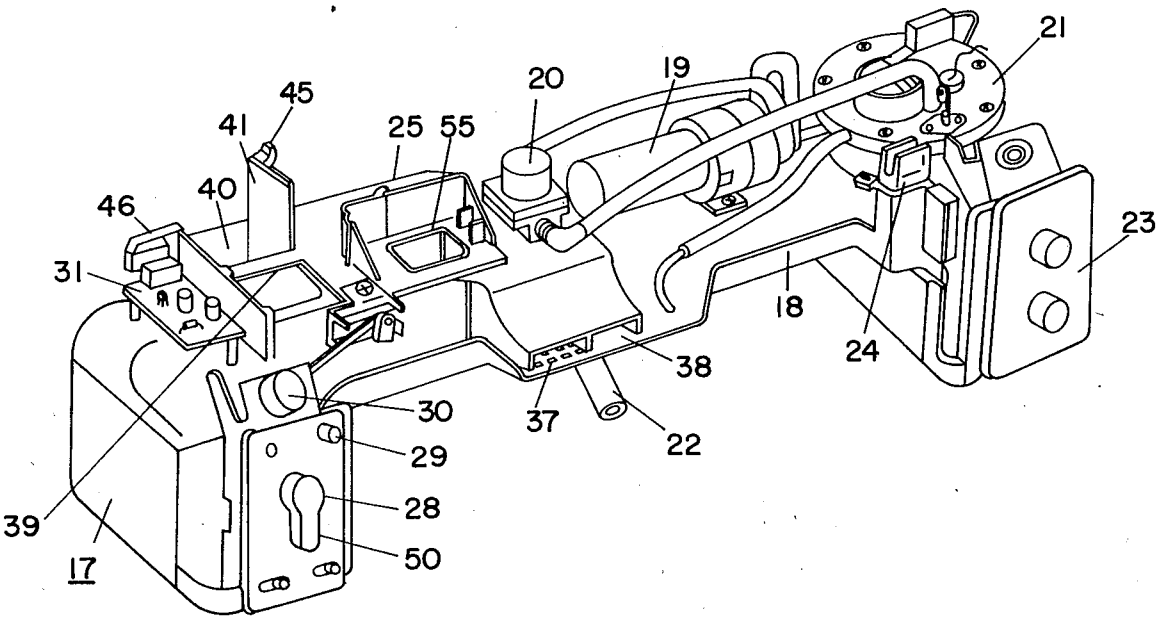
FIG. 2 is a perspective view showing the construction of the main elements of the same equipment.

The above-mentioned sanitary cleaning equipment body 17 has the construction illustrated in FIG. 2. It should be understood that an outer cover therefor is omitted from the illustration. There are also provided, as indicated in FIG. 2, a pump 19 for drawing water from a water tank (not shown) disposed in a lavatory, said pump being mounted on one side of the top of a base member 18, a solenoid valve 20 connected to the delivery side of said pump 19, a warm water tank 21 disposed downstrem of said solenoid valve 20 and having a heater (not shown), a nozzle 22 adapted to deliver a jet of cleaning water against the area of the human body which is to be cleaned within said toilet bowl 14, a control section 23 for adjusting the temperature of tepid cleaning water, the temperature of the toilet seat, etc. and a starter switch 24 which is actuated by the weight applied as the user sits on the seat 15 to thereby energizing a fan means which is described hereinafter.

Figure 3:
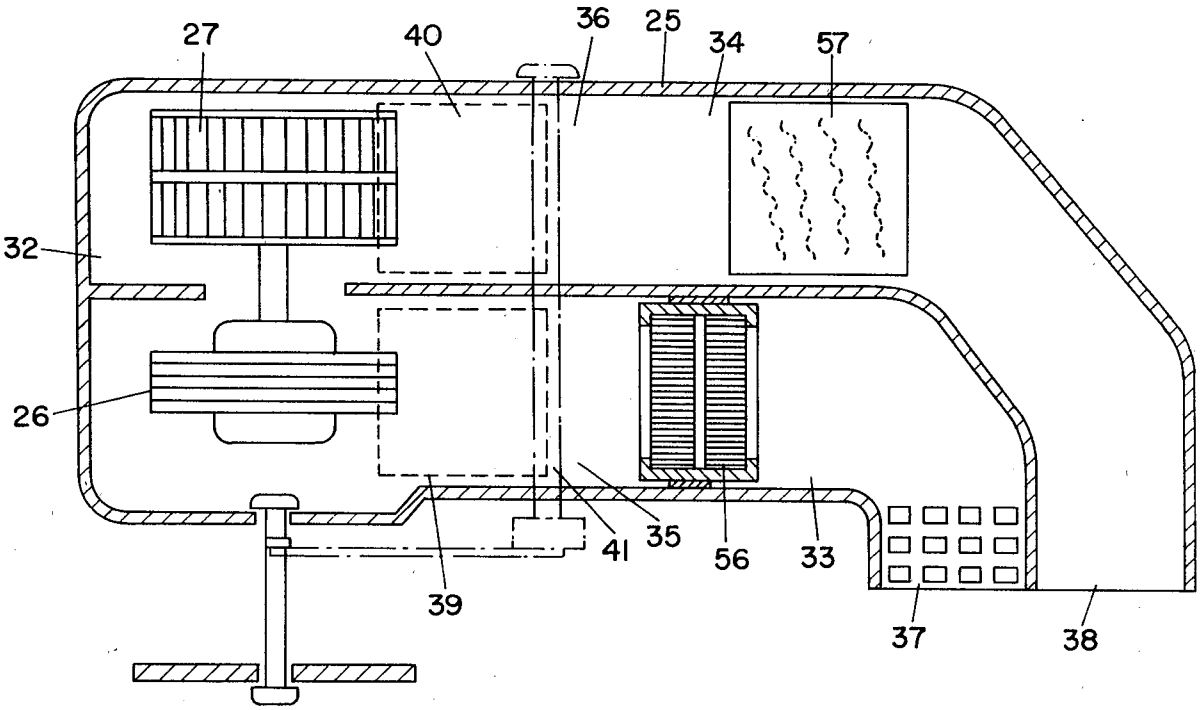
FIG. 3 is a cross-sectional view showing the constructions of the deodorizing and drying sections of the same equipment.

Disposed on the other side of the top of said base member 18 is a wind tunnel unit 25. There are also provided a motor 26 and a fan 27 which are best seen in FIG. 3, a drying/deodorizing switching control means 28, a source control means 29 therefor, and a control means 30 for adjusting the flow velocity of cleaning water. A timer 31, disposed atop, is intended to ensure that even after the user has left the toilet seat 15 after using the toilet and the starter switch 24 has consequently been switched off, the above-mentioned motor 26 will keep running for a preset time period.

Figure 4:
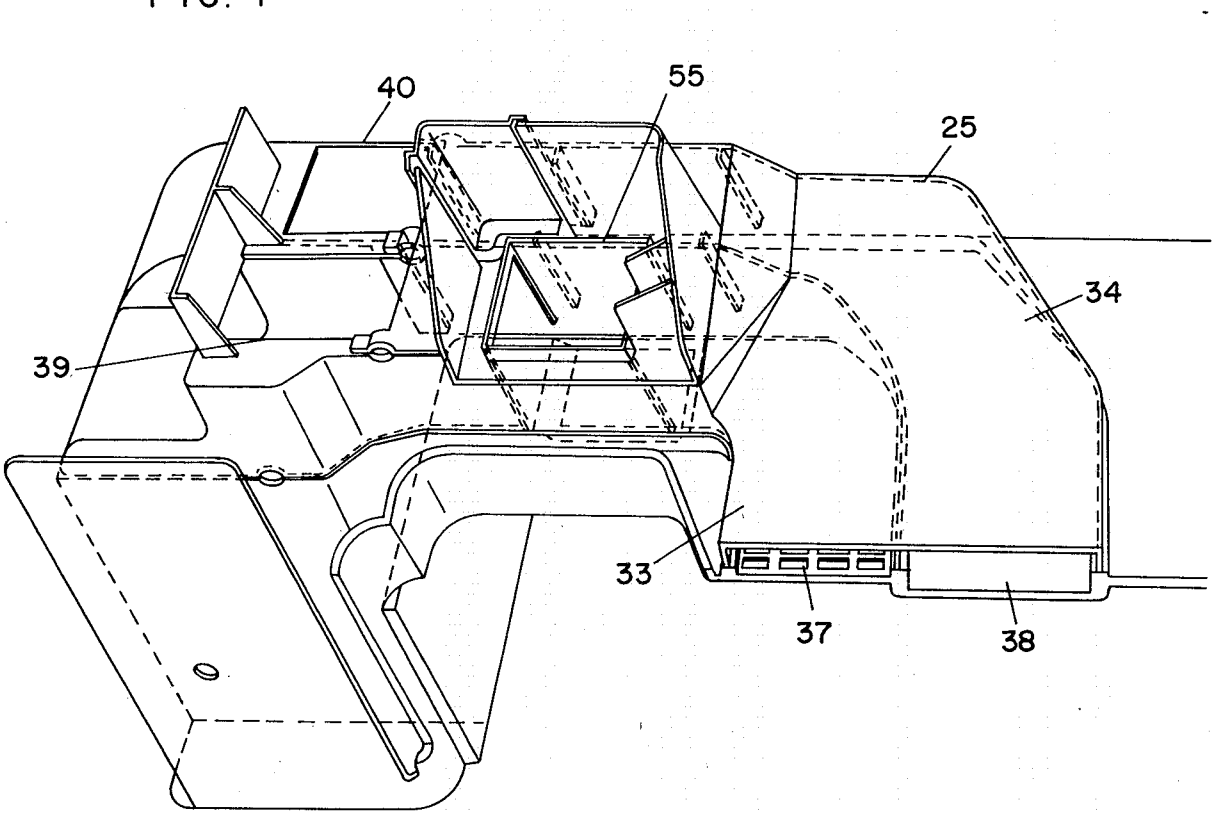
FIG. 4 is a perspective view showing the wind tunnel section of the same equipment.
Figure 7:
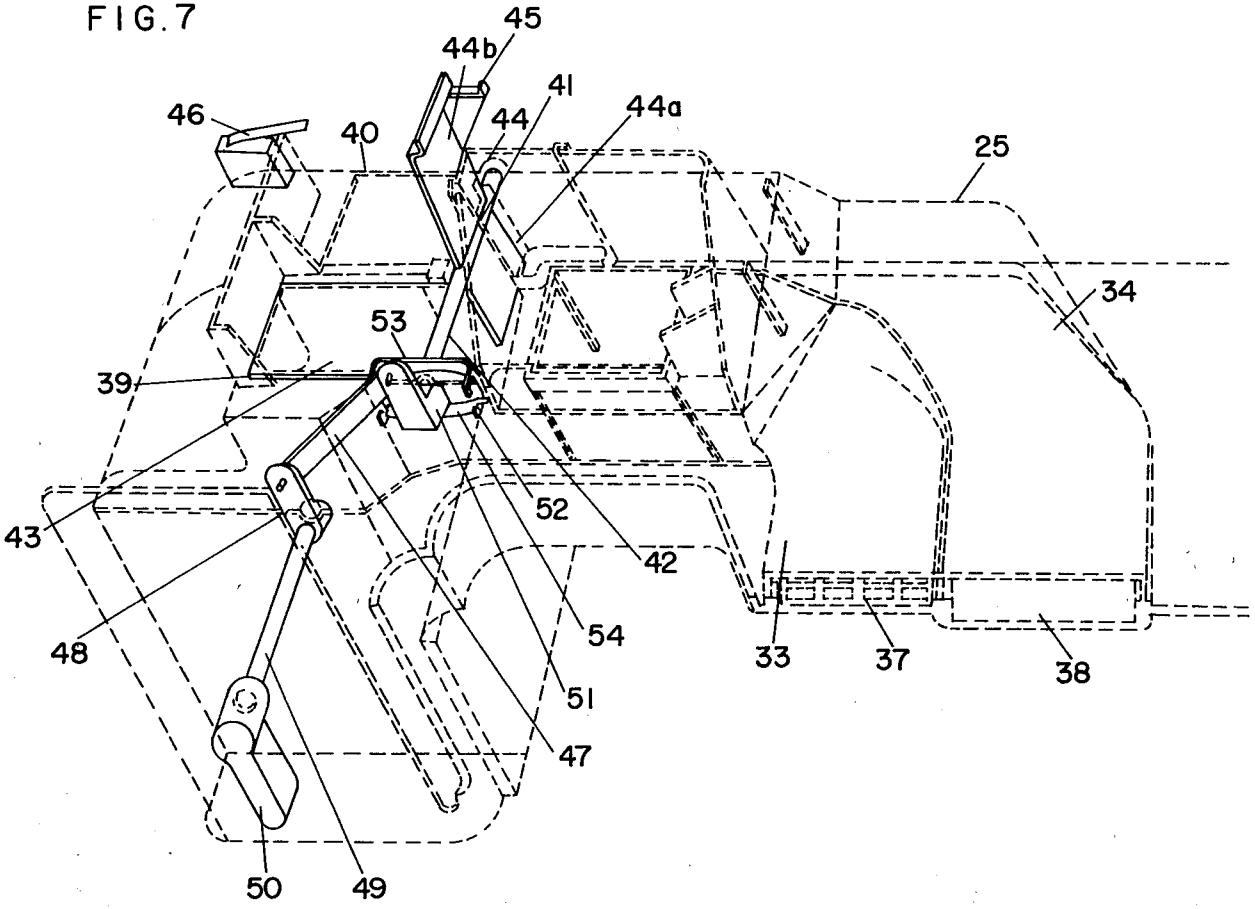
Figure 8:
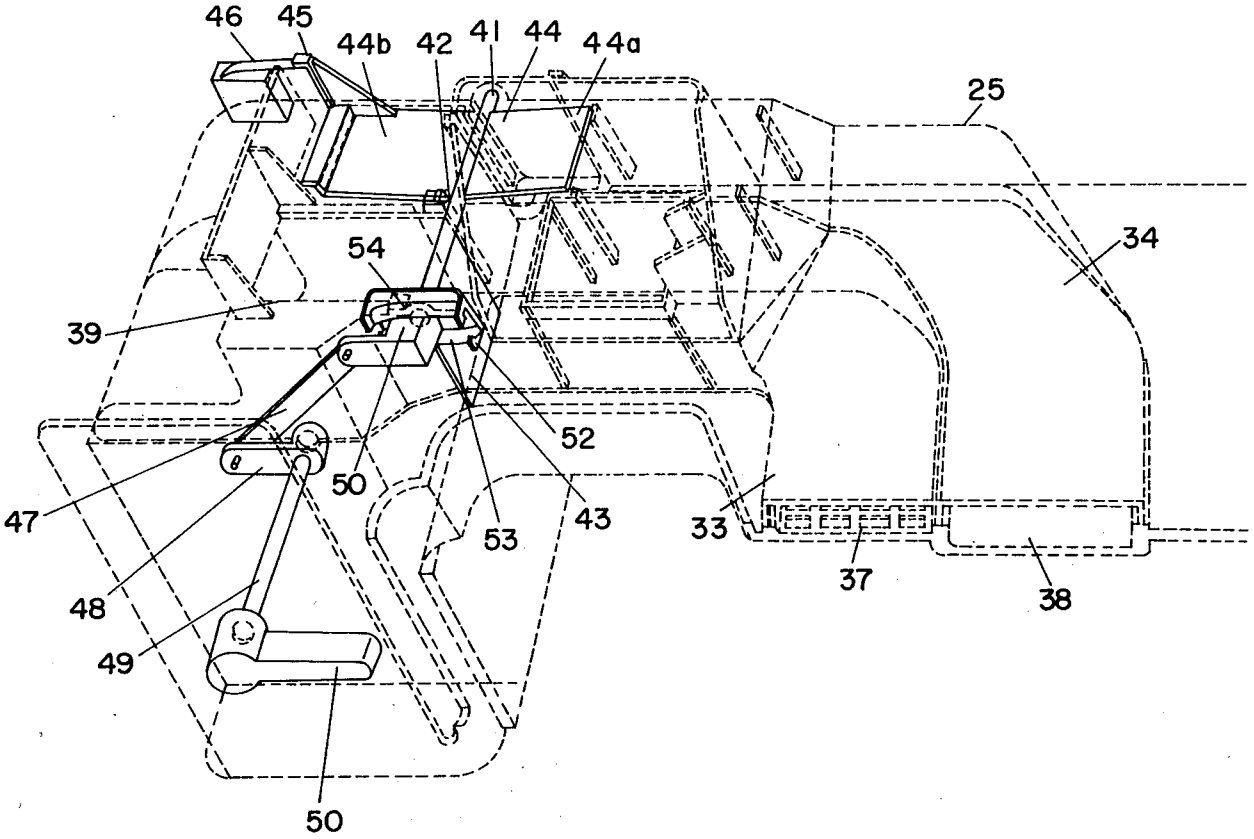
Figure 9A:
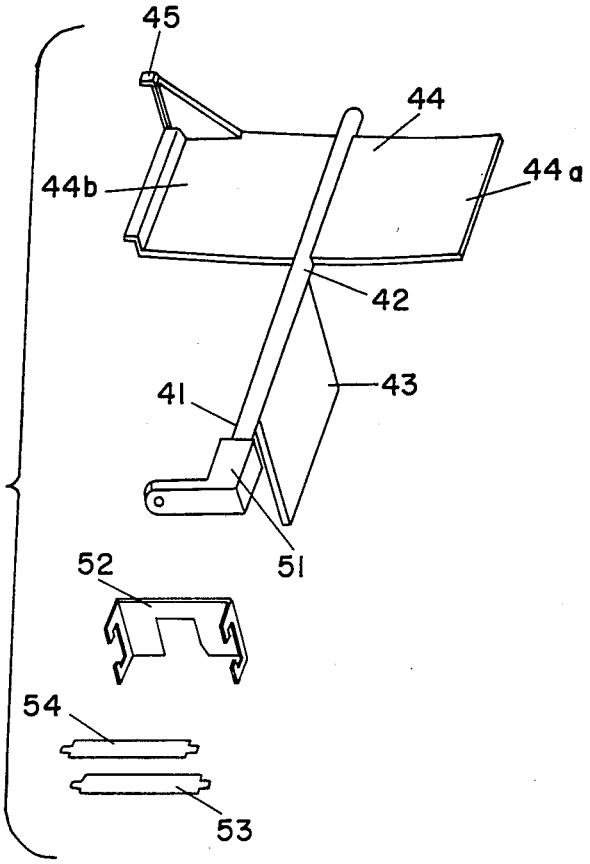
FIG. 9*a, b* are a perspective view of the damper adapted to effect a switching of the wind tunnels of the same equipment and a cross-sectional view of the shaft portion thereof.

The spatial relationship between said wind tunnel unit 25 and said motor 26 and fan 27 is as illustrated in FIG. 3. Thus, the wind tunnel unit 25 has a fan chamber 32 at one end thereof, a first wind tunnel 33 and a second wind tunnel 34. Openings 35, 36 of said first and second wind tunnels 33, 34 at one end thereof are disposed in common plane relationship and communicate with said fan chamber 32, while the other respective ends 37, 38 are disposed near the central edge of said base member 18 and directed toward the bowl 1. Moreover, a face plate (a top plate in this embodiment) of said fan chamber 32 which is perpendicular to the openings 35, 36 of said first and second wind tunnels 33, 34 is provided with openings 39, 40 which are substantially equal in size to the corresponding openings 35, 36 on extension lines of said openings 35, 36 (FIG. 4). Disposed in said fan chamber 32 are a motor 26 and a silocco fan 27 directly coupled to said motor 26. A damper 41 is disposed across the openings 35, 36 of said first and second wind tunnels 33, 34. As shown in FIG. 9, this damper 41 consists of a shaft 42 and a first damper plate 43 and a second damper plate 44 both extending along the shaft. The damper plate 43 and the damper plate 44 project from the shaft 42 in perpendicular directions. Moreover, the first damper plate 43 is configured to project on one side of said shaft 42, while said second damper plate 44 actually consists of a couple of plate members **44*a*, 44*b* projecting on both sides of the shaft 42. The first damper plate 43 and the plate members 44*a*, 44*b* of the second damper plate 44 are configured to close up the openings 35, 36 of the first and second wind tunnels 33, 34 and the openings 39, 40 of the fan chamber 32, respectively. Projecting from one end of the plate member 44*b* of the second damper plate 44 is an actuating member 45 for actuating a switch which is described hereinafter. As shown in FIGS. 7 and 8, the above-mentioned damper 41 is pivotally mounted with its shaft 42 extending on the common line of the openings 39, 40 of the fan chamber 32 and the openings 35, 36 of the wind tunnels 33, 34. Therefore, the first damper plates 43 is adapted to open and close the opening 35 of the first wind tunnel 33 and the first opening 39 of the fan chamber 32, while the first plate member 44*a* of the second damper plate 44 is adapted to open and close the opening 36 of the second wind tunnel 34 and the second plate member 44*b* is adapted to open and close the second opening 40 of the fan chamber 32. Furthermore, when the above-mentioned second plate member 44*b* closes the second opening 40 of the fan chamber 32, the actuating member 45 projecting from the end thereof depresses the drying heater switch 46 disposed at an edge of said opening 40** to turn it on.

As further shown in FIGS. 7 and 8, one end of the shaft 42 of said damper 41 is connected to a control knob 50 through connecting members 47, 48, 49 and it is so constructed that the damper 41 can be switched from one position to the other by turning this control knob 50. As shown in FIG. 9, one end of said shaft 42 is formed as an angular shaft portion 51 which is sandwiched between a pair of resilient plates 53, 54 which are secured in position at both ends thereof by retaining means 52. Thus, the shaft 42 is rotated in a stepwise motion through 90 degrees and is stably maintained in either of the angular positions. More particularly, the above-mentioned angular shaft portion 51 is not exactly square in cross-section but is deformed in a diamond-like quadrangular shape having acute and obtuse angles. Therefore, when this member is pressure-supported between the parallel resilient plates 53, 54, it is biased to turn in one direction as indicated by the arrow-mark (A) (the counterclockwise direction on the drawing). Therefore, the actuating member 45 of the plate member **44*b* exerts a strong pressing force on the switch 46, while the damper plates 43, 44** are pressed against the edges of the openings to be closed.

Figure 5:
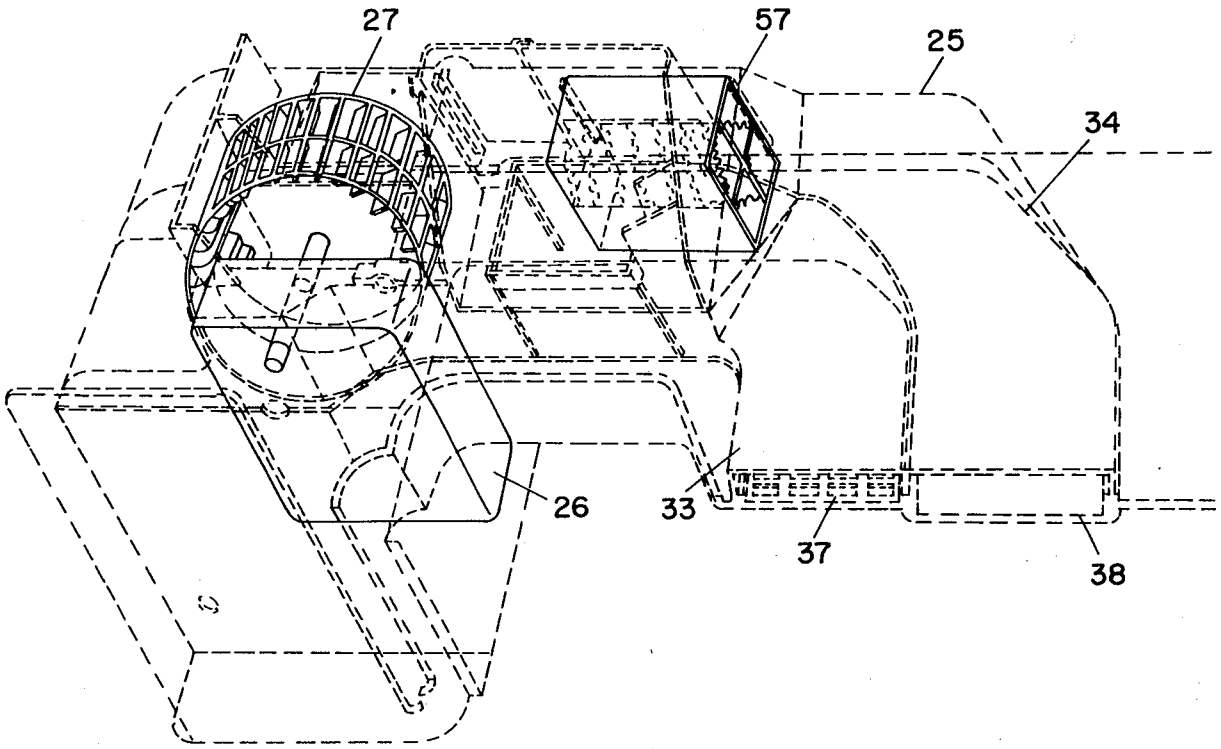
FIGS. 5, 6, 7 and 8 are explanatory diagrams showing the relation of said wind tunnel section with related parts.
Figure 6:
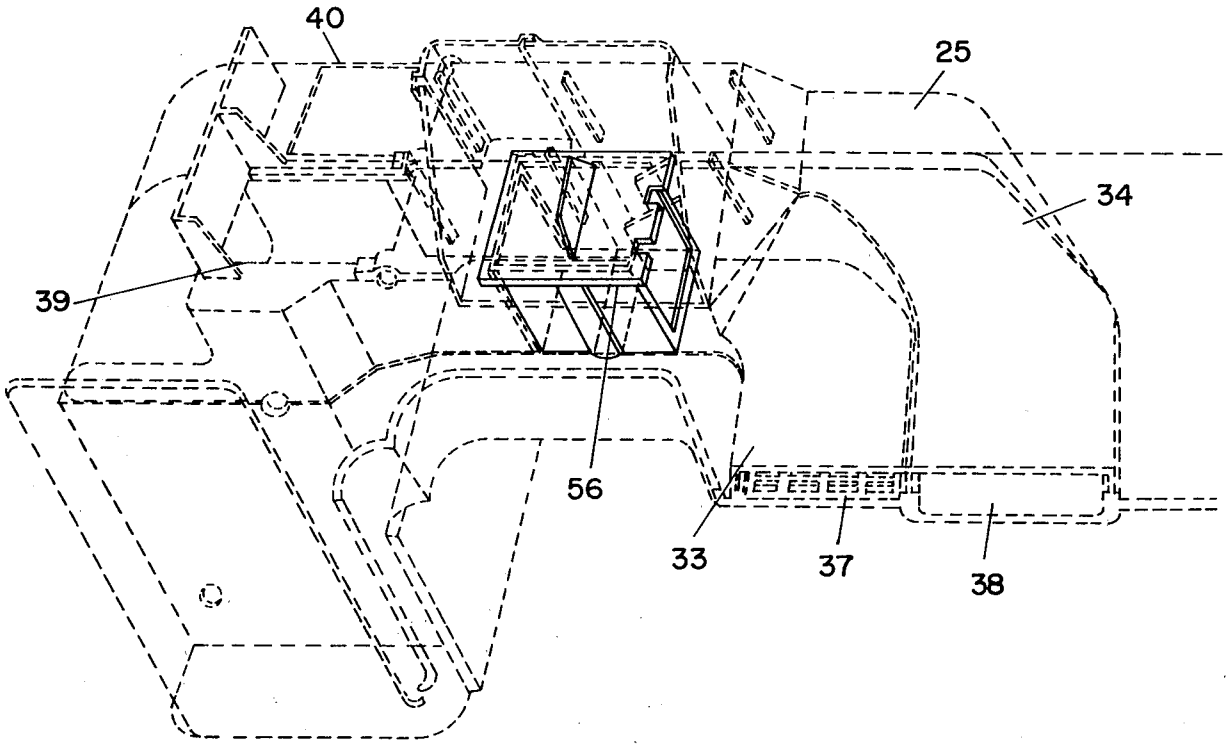

Referring to FIG. 2, a deodorant mounting hole 55 is formed in the above-mentioned first wind tunnel 33 and a deodorant cartridge 56 (see FIGS. 3 and 6) packed with a deodorant such as activated carbon is inserted from said deodorant mounting hole 55. Built in the second wind tunnel 34 is a heater 57 (see FIGS. 3 and 5) for generating a warm air blast. Therefore, the first wind tunnel 33 serves as a wind tunnel for deodorization while the second wind tunnel 34 is adapted to function as a drying wind tunnel. The wind tunnel structure 25 is formed as a unit from a synthetic resin such as polypropylene.

The operation of the sanitary cleaning equipment, the construction of which is as described above, will now be explained. As the user sits on the toilet seat 15, the start switch 24 is switched on, by the load so applied, to energize the motor 26, which, in turn, drives the fan 27. The heater in the toilet seat 15 has already been energized to heat the seat. With the drying/deodorization control section 28 set on the deodorization side, the deodorization mode is executed as will hereinafter be described in detail. As the user, after having used the toilet, manipulates the pump 19, warm cleaning water emerges in jets from the nozzle 22 and washes the selected area of the user's body. After completion of the wash, the drying/deodorization control section 28 is switched to the other side, whereupon a warm blast of air is supplied from the opening 38 into the toilet bowl 14 to dry the selected body area. Thereafter, the drying-/deodorization control section 28 is switched back to the deodorization side. As the user leaves the toilet seat 15, the start switch is switched off but the deodorization mode is further executed for a time determined by the timer 31, at the end of which time the power source therefor is switched off.

The above embodiment is such that the air blast for deodorization and drying is effected by a single fan means comprising a motor 26 and a fan, and is characterized by its wind tunnel construction and switching means. Thus, a fan chamber 32 is disposed at one end of a wind tunnel means 25, and a first wind tunnel 33 having a deodorant means such as a deodorant cartridge 56 and a second wind tunnel having a heater 57 have their respective openings 35 and 36 in a common plane adjacent to said fan chamber 32. The fan chamber 32 has openings 39 and 40 corresponding to said openings 35 and 36, respectively, and each is adapted to be closed and opened in response to the rotation of the damper 41 so that said first wind tunnel 33 and second wind tunnel 34 are selectively brought into communication with the fan chamber 32 of a single fan means, whereby either the deodorization mode or the drying mode is selectively executed.

Thus, because of the configuration of damper 41 as illustrated in FIG. 9, as the control knob 50 is set in the position indicated in FIG. 7, the first damper plate 43 opens the opening 35 of said first wind tunnel 33 and closes the corresponding first opening 39 of the fan chamber 32. On the other hand, with regard to the second damper plates of damper 41, the plate member **44*a* closes the opening of said second wind tunnel 34, while the corresponding opening 40 of said fan chamber 32 is not closed by its plate member 44*b*. As the actuating member 45 of said plate member 44*b* is located apart from the switch 46, the heater 5 in the second wind tunnel 34 is not energized so that the heater 57 does not generate heat. Therefore, in the state shown in FIG. 7, only the first wind tunnel 33 is associated with the fan 27 and the odoriferous air in the toilet 14 is withdrawn from the opening 37 by the revolving fan 27, deodorized as it flows through the deodorant and exhausted from the opening 39 of the fan chamber 32. And the second wind tunnel 34** is not functioning at all. In other words, only the deodorization mode is executed.

Now, as the control knob 50 is turned into the position shown in FIG. 8, the damper 41 is turned through about 90 degrees. In this state, the first damper plate 43 closes the opening 35 of said first wind tunnel 33 and the plate member 44*a* of the second damper plate 44 opens the opening 36 of said second wind tunnel 34, with the plate member 44*b* closing the opening 40 of the fan chamber 32. The actuating member 45 presses the switch 46 ON to energize the heater 57 in said second wind tunnel 34 to generate heat. Therefore, only the second wind tunnel 34 is associated with the fan 27, with the first wind tunnel 33 being not functioning at all. Due to the rotation of the fan 27, the atmospheric air is introduced from the opening 39 of the fan chamber 32 and supplied under pressure to the second wind tunnel 33, where it is warmed by the heater 57. The resultant warm air flow is discharged from the opening 38 against the selected area of the human body to dry the area still wet due to the preceding flushing operation. The heater 57 located in said second wind tunnel 34 is energized only when said control knob 50 is switched to the drying mode. That is to say, the heater 57 generates heat only when air has been supplied to the second wind tunnel 34. Thus, in the deodorization mode, the heater will not generate heat in the absence an air flow in the second wind tunnel 34, thus eliminating the risk of a burn-out problem due to abnormal heating and ensuring safety.

Moreover, since the first wind tunnel 33 remains closed on the drying mode, the deodorant cartridge 56 is not related with the air flow in the second wind tunnel 34, so that there is absolutely no decrease of flow efficiency due to the intervention of the deodorant cartridge 56.

Figure 9B:
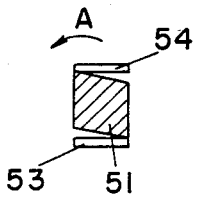
Figure 10:
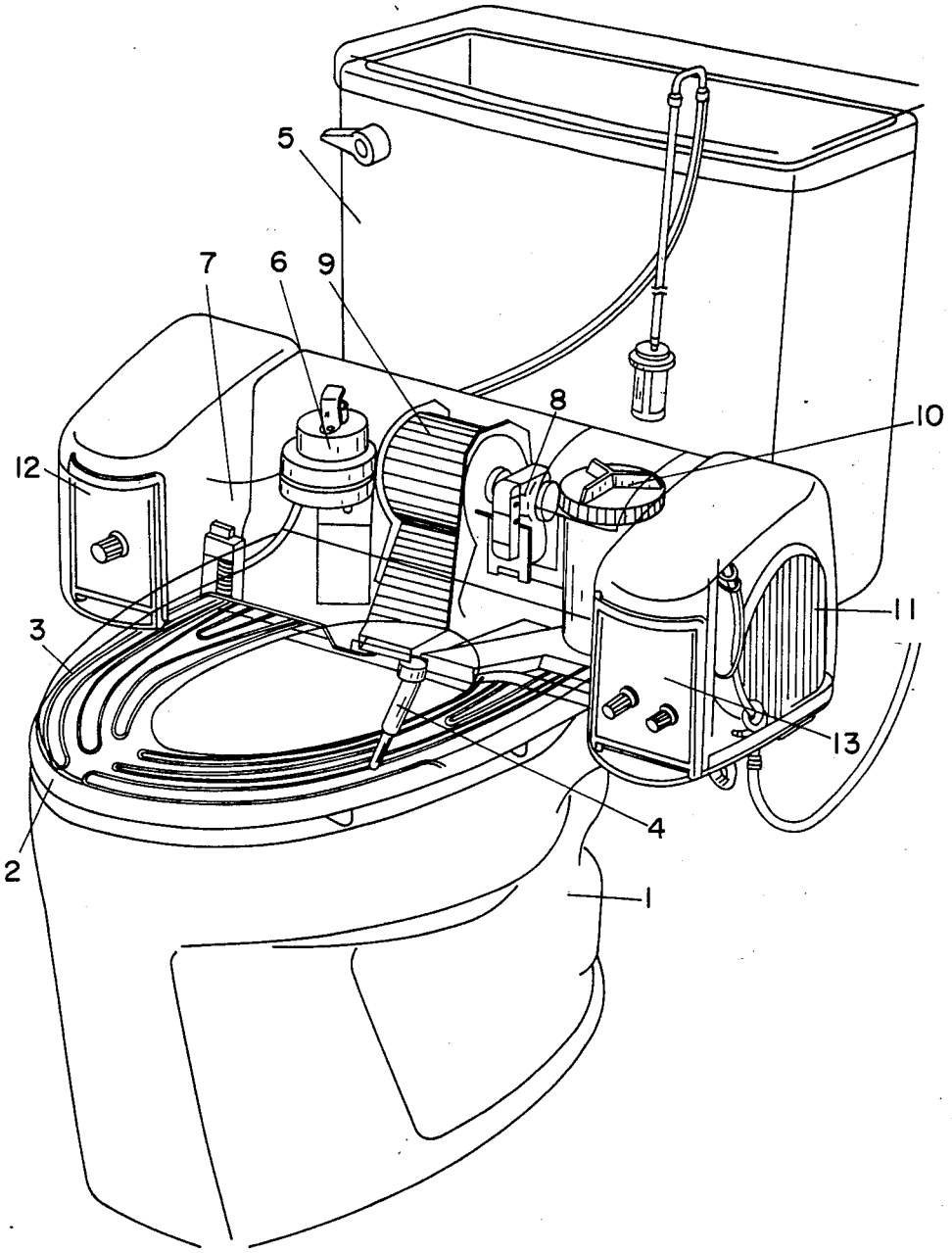
FIG. 10 is a perspective view showing the conventional sanitary cleaning equipment.

Referring to the switching of said damper 41, because the shaft 42 of damper 41 has an angular shaft portion 51 at its end and this angular shaft portion 51 is sandwiched between a pair of resilient plates 53, 54, the rotational switching of the damper 41 is accomplished through an angle of about 90 degrees. Moreover, because the angular shaft portion 51 has been deformed into a diamond-like shape as shown in FIG. 9*b* and, yet, remains pressed by said resilient plates 53, 54, the shaft 42 is biased slightly in a given rotational direction as it is secured in position, thus stabilizing the closed conditions due to the dirst and second damper plates 43 and 44 and the ON-position of the switch 46 as established by the actuating member 45.

In the above embodiment, the damper 41 of FIG. 9 is employed as means for selectively associating the first and second wind tunnels 33, 34 with the fan means. In lieu of using such a damper 41, it is possible to modify the positions of the openings of said first and second wind tunnels 33, 34 and the openings of said fan chamber 32 and employ the correspondingly configured damper 41. Thus, this invention is not limited to the damper (41) shape depicted in FIG. 9. For example, it is possible to employ a damper 41 of the sliding type, not the revolving type, which is capable of sliding to open and close the openings of said first and second wind tunnels 33, 34 and said fan chamber 32. Aside from those dampers, it is also possible to employ an electromagnetic mechanism to control the closing and opening of the damper 41. The deodorant also need not be a cartridge but be a packaged deodorant disposed in the required position. Further, the first and second wind tunnels 33, 34 need not necessarily be an integral unit but may be two independent units disposed in parallel. The fan 27 is not limited to a sirocco fan and the heater 57 in the wind tunnel need not necessarily be a nichrome heater but may be a honeycomb heater comprising a resistance element having a positive temperature characteristic. Moreover, the flushing device and the toilet seat heater are not limited to the constructions illustrated.

Since, as explained hereinabove, the flow of air for deodorization and that for drying are both provided by a single fan means in accordance with this invention, there can be realized a drastic decrease in the bulk of the equipment and the manufacturing cost can also be reduced remarkably. Furthermore, the deodorant does not present a resistance to the drying air flow and the efficiency of warm air delivery is improved. In addition, since the heater section is supplied with a large volume of air, there is no abnormal heating and, consequently, the invention provides a sanitary cleaing equipment which is very desirable from safety points of view as well.

Moreover, because the heater does not act as a resistance to deodorizing air flow, the efficiency of deodorization is also increased.

What is claimed is:

1. Sanitary cleaning equipment for use with a toilet which accommodates a human body in a seated position, comprising: flushing means for directing a jet of water against an area of said body to be cleaned; and deodorizing and drying means for selectively withdrawing odoriferous air from the neighborhood of said area to be cleaned and for directing a jet of warm air against said area to be cleaned, said deodorizing and drying means including a fan, a first wind tunnel leading toward said fan to convey said odoriferous air thereto, said first wind tunnel having means for receiving a deodorant therein, a heater, a second wind tunnel within which said heater is mounted, said second wind tunnel leading from said fan to receive air for said jet of warm air, and manually actuable damper means for selectively permitting either said first wind tunnel or said second wind tunnel to communicate with said fan so that said fan selectively withdraws said odoriferous air through said first wind tunnel or supplies said jet of warm air through said second wind tunnel.

2. The sanitary cleaning equipment of claim 1, wherein said deodorizing and drying means further comprises switch means cooperating with said damper means for actuating said heater when said second wind tunnel communicates with said fan.

3. The sanitary cleaning equipment of claim 1, wherein said damper means comprises at least two moveably mounted damper plates which are configured to close one wind tunnel or the other.

4. The sanitary cleaning equipment of claim 1, wherein said deodorizing and drying means further comprises a switch for supplying electric current to said heater, and wherein said damper means comprises means for closing said switch when said damper means permits said fan to communicate with said second wind tunnel.

5. The sanitary cleaning equipment of claim 4, wherein said deodorizing and drying means further comprises a fan chamber having an opening therein, said fan being disposed in said fan chamber and said first and second wind tunnels being connected to said fan chamber, wherein said switch is disposed adjacent said opening of said fan chamber, and wherein said means for closing said switch comprises a pivotably mounted element positioned to engage said switch.

6. The sanitary cleaning equipment of claim 5, wherein said pivotably mounted element comprises a pivotably mounted plate member to selectively close said opening of said fan chamber, and an actuating member mounted on said plate member at a position to engage said switch.

7. The sanitary cleaning equipment of claim 1, wherein said deodorizing and drying means further comprises a fan chamber in which said fan is disposed, said fan chamber being connected to said first wind tunnel at a first wind tunnel opening and to said second wind tunnel at a second wind tunnel opening and additionally having a first fan chamber opening adjacent said first wind tunnel opening and a second fan chamber opening adjacent said second wind tunnel opening, said first and second wind tunnel openings being disposed in a wind tunnel opening plane and said first and second fan chamber openings being disposed in a fan chamber opening plane that is perpendicular to said wind tunnel opening plane, and wherein said damper means comprises a rotatably mounted shaft having an axis that is parallel to said wind tunnel opening plane and said fan chamber opening plane, a first damper plate connected to said shaft and positioned to close said first wind tunnel opening at one rotary position of said shaft and to close said first fan chamber opening when said shaft is rotated through 90 degrees from said one rotary position, said first damper plate being disposed in a plane, and a pair of second damper plates connected to said shaft and disposed in a plane that is perpendiculr to the plane of said first damper plate, said second damper plates being disposed so that one of the second damper plates closes said second wind tunnel opening when said first damper plate closes said first fan chamber opening and so that the other of said second damper plates closes said second fan chamber opening when said first damper plate closes said first wind tunnel opening.

8. The sanitary cleaning equipment of claim 7, wherein said damper means additionally comprises a cam connected to said shaft, said cam having a substantially diamond shaped portion, and resilient plates engaging said diamond shaped portion to rotationally position said shaft.

9. Sanitary cleaing equipment for use with a toilet which accommodates a human body in a seated position, comprising:

flushing means for directing a jet of water against an area of said body to be cleaned, said flushing means including a nozzle;

a fan chamber having first, second, third, and fourth openings therein;

a fan disposed in said fan chamber; a first wind tunnel having a pair of ends, one end of said first wind tunnel being positioned adjacent said nozzle and the other end of said first wind tunnel being connected to said fan chamber at the first opening thereof, said first wind tunnel having means for receiving a deodorizing agent therein;

a second wind tunnel having a pair of ends, one end of said second wind tunnel being positioned adjacent said nozzle and the other end of said second wind tunnel being connected to said fan chamber at the second opening thereof;

a heater disposed in said second wind tunnel;

a manually actuated control member that is mounted for movement between a first position and a second position; and moveably mounted damper means, operatively connected to said control member, for closing said second and third openings when said control member is in said first position to permit said fan to withdraw odoriferous air from the region of said nozzle via said first wind tunnel and expel the withdrawn air from said fan chamber via said fourth opening, and for closing said first and fourth openings when said control member is in said second position to permit said fan to receive air into said fan chamber via said third opening and blow the received air to the region of said nozzle via said second wind tunnel.

10. The sanitary cleaing equipment of claim 9, wherein said first and second openings are disposed in a wind tunnel opening plane and said third and fourth openings are disposed in a fan chamber opening plane that is substantially perpendicular to said wind tunnel opening plane, and wherein said damper means comprises a rotatably mounted shaft that is operatively connected to said control member, said shaft being moved to a first rotary position when said control member is moved to its first position and being moved to a second rotary position when said control member is moved to its second position, a first damper plate affixed to said shaft at a position to close said third opening when said shaft is in its first rotary position and to close said first opening when said shaft is in its second rotary position, and a pair of second damper plates affixed to said shaft, one second damper plate being positioned to close said second opening when said shaft is in its first rotary position and the other second damper plate being positioned to close said fourth opening when said shaft is in its second rotary position.

11. The sanitary cleaning equipment of claim 10, further comprising a switch electrically connected to said heater and means affixed to one of said damper plates for closing said switch when said shaft is in its second rotary position.

12. The sanitary cleaning equipment of claim 11, wherein said damper means further comprises cam means for biassing said shaft to one of its first and second rotary positions.

* * * * *